United States Patent [19]

Kerr

[11] 4,136,589

[45] Jan. 30, 1979

[54] KEY HOLDING TOOL

[76] Inventor: John Kerr, 1505 SE. Division, Portland, Oreg. 97202

[21] Appl. No.: 814,479

[22] Filed: Jul. 11, 1977

[51] Int. Cl.[2] ..... B25B 7/02

[52] U.S. Cl. ..... 81/425 A

[58] Field of Search ..... 81/425 R, 425 A, 426, 81/419, 418

[56] References Cited

U.S. PATENT DOCUMENTS

| | | | |
|---|---|---|---|
| 1,818,869 | 8/1931 | Reede | 81/5.1 R |
| 2,352,917 | 7/1944 | Scott | 81/5.1 R |
| 2,590,031 | 3/1952 | Petersen | 81/418 |
| 3,367,703 | 2/1968 | Pittis | 81/418 |

*Primary Examiner*—James L. Jones, Jr.

*Attorney, Agent, or Firm*—Eugene M. Eckelman

[57] ABSTRACT

Clamping jaws are associated with a tool of the type which is arranged to open the jaws and to close them in clamping engagement on a key blank. The jaws include a longitudinal dimension biting portion for holding a key blank in a rigid longitudinal extension of the tool for improved manipulation of the key blank. One embodiment of the invention includes a projection disposed rearward of the bitting portion arranged to fit in the usual hole in the head of the key for providing additional stability.

1 Claim, 10 Drawing Figures

KEY HOLDING TOOL

CL BACKGROUND OF THE INVENTION

This invention relates to a new and useful key holding tool. It is often necessary for locksmiths to fit keys in locks such as when a house key, automobile key or the like has been lost by the owner. A skilled locksmith in fitting such a key now grips a key blank in a pair of pliers and through experienced feel can obtain the pattern of bitting required to fit the tumblers of the lock. In using a pair of pliers, the key blank cannot be held in the pliers as a rigid extension thereof and a disadvantage results in that the locksmith cannot get a good feel of the tumblers in the lock. In addition, the movement of the key in the plier jaws scratches the head of the key in a large area and on both sides.

SUMMARY OF THE INVENTION

According to the present invention and forming a primary objective thereof, jaw structure is provided on a tool which is arranged to clamp a key blank so that said blank will form a clamped rigid extension of the tool.

The structure to carry out the object of the invention comprises a jaw arrangement employing one flat surface on one jaw and a peaked portion on the other jaw arranged to firmly clamp a key blank to hold it steady in the jaws as a rigid extension of the tool. One embodiment of the invention employs a longitudinally extending peaked portion and another embodiment employs longitudinally spaced tooth-like prongs.

DETAILED DESCRIPTION OF A PREFERRED EMBODIMENT

Figure 3:
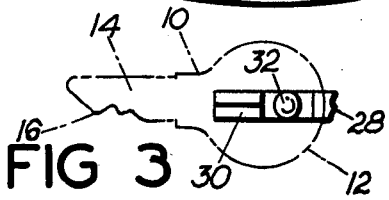
FIG. 3 is a fragmentary sectional view taken on the line 3—3 of FIG. 1.
Figure 5:
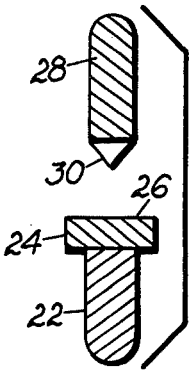
FIG. 5 is an enlarged sectional view taken on the line 5—5 of FIG. 4.

With particular reference to the drwings, reference is first made to FIG. 3 which shows a conventional type key 10 in broken lines. Such a key includes a head portion 12 and a bit or shank portion 14 provided with the usual bitting 16. The purpose of the present invention is to provide a tool capable of holding a key blank (without the bitting 16) in an improved manner so that a proper feel of lock tumblers can be achieved to form the bitting 16.

The invention resides primarily in the jaw structure of a tool 18 which may comprise a vise-grip-type pliers. As is well known, this type of tool has means 20 which by suitable adjustment is capable of causing the jaws of the tool to be locked tight on an article placed in the jaws. It is to be understood that other types of tools capable of clamping a pair of jaws together tightly can be used with the invention. By using vice-grip pliers presently on the market and the conventional jaws, or other types of tool which can possibly clamp a key blank, the key blank cannot be held sufficiently stable for forming a rigid extension of the tool. The delicate feel in fitting a key cannot thus be accomplished with conventional tools.

Figure 2:
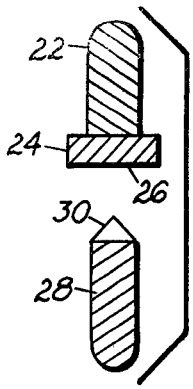
FIG. 2 is an enlarged sectional view taken on the line 2—2 of FIG. 1.
Figure 1:
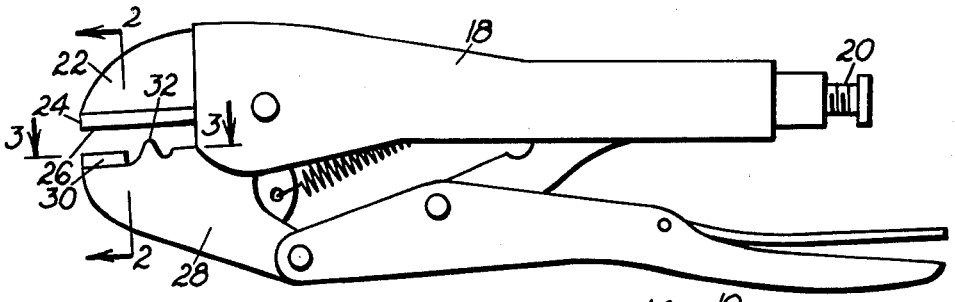
FIG. 1 is a side elevational view of a tool having jaw structure embodying features of the present invention.
Figure 4:
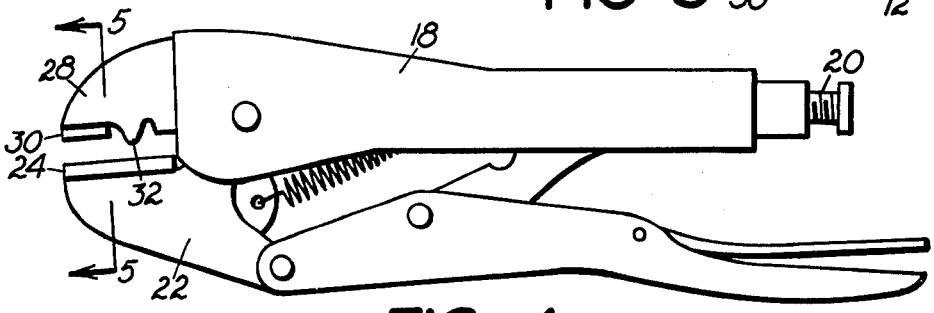
FIG. 4 is a view similar to FIG. 1 but showing a reversal of the jaws.
Figure 7:
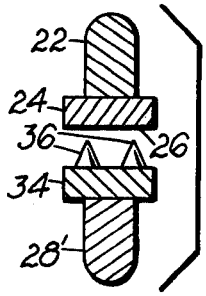
FIG. 7 is an enlarged sectional view taken on the line 7—7 of FIG. 6.

According to the invention and with reference first to FIG. 1, and also to FIG. 4 which is similar to FIG. 1 except that it shows a reversal of the jaws, a first jaw 22 has a widened head 24 with a flat inwardly facing surface 26. The opposite jaw 28 has an inwardly directed peaked portion 30 having a longitudinal length sufficient to firmly hold the key in a stable rigid extension of the tool when the jaws are closed. A length of one cm. is of sufficient length for the peaked portion 30 in the usual case although various other lengths may be used.

Jaw 28 has an integral post or projection 32 disposed rearward of the longitudinal peaked portion 30. This post is generally conical in shape and has a rounded top surface. It fits in the usual hole in the head portion 12 of the key blank and helps to stabilize the blank in the jaws.

In mounting a key in the pliers, the pliers is opened and the key blank inserted with the head portion between the jaws and the post 32 projecting into the hole in the head portion of the key blank. The jaws are then closed which causes the peaked portion 30 to bite into one surface of the head portion of the key blank. The longitudinal biting or gripping contact with the key will hold it firmly in a longitudinal rigid extension of the tool. The post 32 also provides some stabilization of the key blank since when the jaws clamp down on the blank, at least a small portion of the post will bind in the hole of the blank to assist in anchoring it in position.

Figure 6:
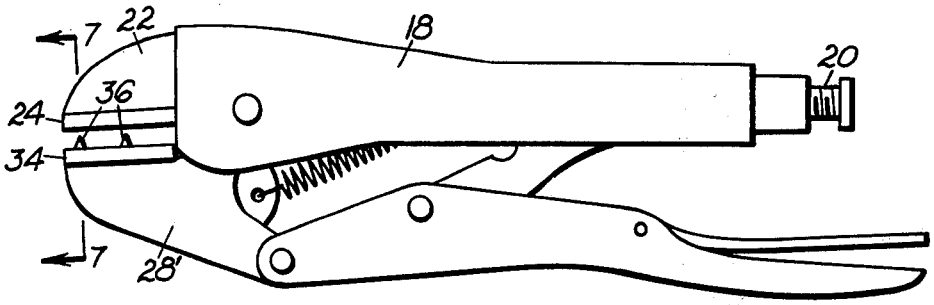
FIG. 6 is an elevational view of a tool employing a second embodiment of jaw structure.
Figure 9:
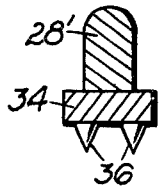
FIG. 9 is an enlarged sectional view taken on the line 9—9 of FIG. 8.
Figure 10:
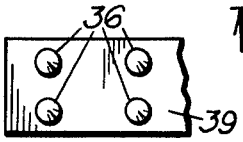
FIG. 10 is a fragmentary plan view taken on the line 10—10 of FIG. 8.
Figure 8:
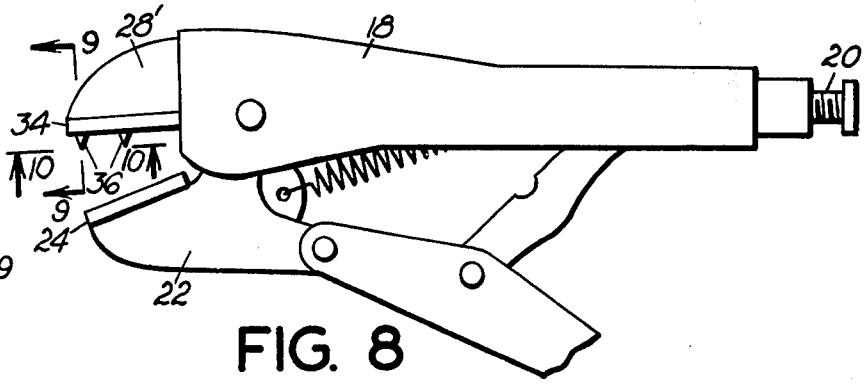
FIG. 8 is a view similar to FIG. 6 but showing a reversal of the jaws.

With reference to FIG. 6, and also to FIG. 8 which is similar to FIG. 6 except that it shows a reversal of the jaws, jaw 22 is the same as in FIGS. 1 and 4 in that it has the head portion 24 with a flat inwardly directed surface 26. The other jaw, designated by the numeral 28', has a head portion 34 provided with pairs of inwardly directed prongs 36. The arrangement of the prongs is best seen in FIG. 10 wherein two pairs of such prongs are provided, with the prongs in a pair being disposed in longitudinal spaced relationship. Upon clamping a key blank in the jaws of FIGS. 6 and 8, the longitudinally spaced prongs 36 will bite into the head portion of the key and hole the key stable as a rigid extension of the tool the same as the structure of FIG. 1. Although two pairs of prongs 36 are shown and provide a most effective grip, a single pair of the longitudinally spaced prongs may be employed. The embodiments of FIGS. 6 and 8 do not employ the post 32 as in FIGS. 1 and 4, and instead the head portion 24 extends the full length of the jaw.

According to the present invention, a key can be held in a longitudinal rigid extension of the tool 18 with the result that a better feel can be obtained for constructing a key to fit a selected lock. Once the key is clamped in the tool, it will not have movement relative to the tool. Thus, a minimum of damage is done to the key blank.

It is to be understood that the forms of my invention herein shown and described are to be taken as preferred examples of the same and that various other changes in the shape, size and arrangement of parts may be resorted to without departing from the spirit of my invention, or the scope of the subjoined claims.

Having thus described my invention, I claim:

1. A key holding tool for keys of the type having a shank portion and a flat head portion with a key ring hole therein, said tool comprising (a) first and second jaws having forward ends and arranged for movement between open and closed positions, (b) a flat longitudinal base surface on said first jaw leading rearwardly from said forward end and facing said second jaw, (c) said base surface being arranged to engage flatwise one side of the head portion of a key, (d) a longitudinally extending sharpened projection on said second jaw leading rearwardly from said forward end and being directed toward said base surface, (e) said projection being arranged to cut slightly into the metal of the head portion of a key when the jaws are clamped on a key, (f) said sharpened projection having a dimension such as to provide a longitudinal engagement on the head portion of the key to clamp it firmly against said base surface and form a rigid extension of the key from the tool, (g) and an integral post on said second jaw spaced rearwardly from said sharpened projection and arranged to fit in the key ring hole in the key.

* * * * *